United States Patent [19]

Dittman

[11] 4,083,502

[45] Apr. 11, 1978

[54] MATERIAL SHREDDER, ESPECIALLY FOR SUGAR CANE

[75] Inventor: Dietrich Dittman, Salzgitter, Germany

[73] Assignee: Braunschweigische Maschinenbauanstalt, Braunschweig, Germany

[21] Appl. No.: 764,748

[22] Filed: Feb. 2, 1977

[30] Foreign Application Priority Data

Feb. 10, 1976 Germany ..... 2605050

[51] Int. Cl.[2] ..... B02C 13/04

[52] U.S. Cl. ..... 241/189 R; 241/239

[58] Field of Search ..... 241/189 R, 189 A, 190, 241/239, 240, 241

[56] References Cited

U.S. PATENT DOCUMENTS

| | | | |
|---|---|---|---|
| 1,783,373 | 12/1930 | Borton | 241/239 X |
| 1,864,973 | 6/1932 | Buchanan | 241/239 X |
| 3,128,953 | 4/1964 | Wageneder | 241/241 |
| 3,684,196 | 8/1972 | Hankins | 241/240 X |
| 4,017,035 | 4/1977 | Stuttmann | 241/189 R |

*Primary Examiner*—Roy Lake
*Assistant Examiner*—Howard N. Goldberg
*Attorney, Agent, or Firm*—W. G. Fasse; W. W. Roberts

[57] ABSTRACT

A shredder for crushing materials, such as sugar cane, has a housing and a hammer rotor rotatably mounted in the housing for cooperation with an anvil resiliently mounted in the housing. The anvil is journaled at each of its lateral ends to a respective guide rod which form an acute angle with the anvil proper. The other end of the guide rod is journaled to the housing. At least one spring biased pressure member is mounted to the housing and acts on the anvil so that an effective force component extends tangentially to the anvil curvature. Adjustable abutments mounted to the housing cooperate with the anvil to adjust a working gap between the hammer rotor and the anvil.

10 Claims, 7 Drawing Figures

MATERIAL SHREDDER, ESPECIALLY FOR SUGAR CANE

BACKGROUND OF THE INVENTION

The present invention relates to a material shredder, especially for crushing sugar cane. Such shredders have a hammer rotor rotatably supported in the housing. The rotor cooperates with an anvil yieldably mounted in the housing.

The ever increasing mechanization of the harvesting of sugar cane makes it practically unavoidable that stones and sometimes even metal parts are supplied into the shredder along with the sugar cane. As a result, the hammers of the rotor and the respective anvil members are subjected to heavy wear and tear and quite frequently damages are not avoidable.

Such disadvantages are due to the fact that in a number of conventional shredders, the anvil is merely adjustable relative to the rotor but the anvil is not able to yield relative to the rotor when relatively hard extraneous matter enter into the working gap between the hammers of the rotor and the anvil. German Patent Publication (DAS) 1,782,530 and U.S. Pat. Nos. 3,248,263, as well as 3,351,295 describe shredders of the just mentioned type.

British Pat. No. 462,128 describes a shredder having a rotor with knives cooperating with counter knives secured to the anvil. The anvil is journaled to a lever system at its end facing toward the material inlet. The opposite end of the anvil is tiltable about an axis extending in parallel to the rotor axis. The rotor axis and the journal axis of the anvil cannot yield relative to each other. In other words, the spacing between the rotor axis and the anvil journal axis is constant. A tension spring is effective on the anvil through the lever system in such a manner that the anvil is pressed toward the rotor. Due to this arrangement, the anvil and its knives are able to evade extraneous bodies at the beginning of the working gap between the anvil and the rotor adjacent to the material inlet since the anvil end adjacent to the material inlet can be deflected against the biasing spring action. Howver, the opposite end of the anvil cannot yield. Therefore, the interacting knives are subject to extremely heavy wear and tear or even destruction when extraneous matter or bodies pass through the working gap.

U.S. Pat. No. 1,864,973 discloses a rock crusher constructed as a shredder. The anvil is arranged relative to the rotor in such a manner that the working gap tapers in the direction of the material throughput. The anvil end at the material outlet is subjected to the bias of a spring which presses the anvil towards the rotor. Thus, the anvil is able to yield radially around a tilting axis located at its opposite end namely the end adjacent to the inlet. Disregarding for the moment that a wedge shaped tapered working gap is not suitable for shredding sugar can or similar material, the use of this type of structure for the anvil support in a sugar can shredder would not avoid the above described disadvantages of the prior art because the springs acting on the anvil in a substantially radially effective direction resist a radial deflection of the anvil by extraneous matter in the working gap in such a manner that, depending on the type of spring characteristic, the spring resistance to yielding of the anvil exhibits a steep rise in response to an increasing deflection. As a result, any extraneous matter must pass the elements which interact in a cutting manner at an extremely increased working pressure. This type of anvil yielding might, at best, somewhat reduce the wear and tear, however, it is not possible to reliably avoid the destruction of the cutting edges in this type of apparatus.

In connection with garbage shredders, it is very likely that metal parts or other resisting and bulky matters enter into the working gap. Therefore, it is conventional to construct the anvil in such garbage shredders in such a manner that the anvil or parts thereof may yield resiliently. First, German Pat. No. 1,104,301 discloses, for example, a shredder provided with a row of spring biased individual tearing teeth. However, the effective direction of the spring forces extends substantially radially relative to the rotational axis of the rotor. The individual tearing teeth serving as cutting elements of the anvil are not able to prepare sugar cane in a manner necessary for the processing following the shredding. Further, this type of structure has the disadvantage that, depending on the type of spring characteristic, the resistance offered by the tearing teeth against any deflection rises steeply as large radial deflections are required. Stated differently, the tearing teeth offer a higher resistance against extraneous bodies in the material to be shredded than against the material to be shredded. Another garbage shredder which is disclosed in German Patent Publication (DAS) 2,034,074 as well as in the German Utility Model 7,025,833, comprises a rotor suspended at its both ends by means of two parallel guide rods of equal lengths. The guide rods are operatively secured to the housing, whereby the rotor, the housing, and the guide rods form a parallelogram. The guide rods which support the anvil at the inlet for the material to be shredded is adjustable in its length by means of an adjustable spindle, whereby the size of the working gap between the rotor and the anvil may be selected. However, rubber springs are provided as part of the adjusting spindle, whereby the anvil is able to swing about its normal position, thereby deforming the rubber springs. Due to the arrangement of the guide rod parallelogram, the anvil can yield only in such a manner that it is moved away from the rotor uniformly along its entire length. Such a feature is undesirable in a sugar cane shredder because it would cause an unsatisfactory shredding since a substantial proportion of the sugar cane would leave the shredder without having been sufficiently shredded. Further, this type of lever or rod support of the anvil also does not provide a reliable protection of the shredding elements against an increased loading. This is so because the rubber springs in the adjustment spindles also have a characteristic with a very steep rise of the spring resistance, whereby a heavy wear and tear or a destruction of the anvil cutting edges or of the hammers cannot be avoided. In view of the above it will be noted that neither the known shredders for sugar cane nor the garbage shredders of the prior art which operate in the manner of hammer mills, provide any suggestion how to avoid excessive loads on the interacting crushing elements.

OBJECTS OF THE INVENTION

In view of the above, it is the aim of the invention to achieve the following objects singly or in combination:

to construct a shredder of the described type in which the anvil may be supported in a yielding manner, but with a force necessary for the particular type of material to be shredded, whereby the resistance of the anvil against yielding in the radial direction is the same at any point of the anvil;

to support the anvil in such a manner that even where large anvil deflections are required, the resistance of the anvil against such deflection will increase only to a very small extent or not at all;

to support the anvil in such a manner that the working gap between anvil and hammer rotor is substantially maintained while simultaneously permitting the anvil to yield locally so to speak;

to arrange the spring biasing of the anvil in such a manner that a substantial force component of the biasing spring means is effective tangentially relative to the anvil;

to construct the anvil so that it is bent, whereby its concave surface faces the hammer rotor, circumferentially, preferably for at least 90°; and to arrange two anvils relative to one hammer rotor and relative to the direction of rotation in such a manner that both anvils are supported and spring loaded in the same manner.

SUMMARY OF THE INVENTION

According to the invention, there is provided a shredder especially for sugar cane, wherein the anvil is journaled to guide rods at the lateral ends thereof adjacent to the material inlet side of the anvil, whereby the guide rods form an acute angle with the anvil. The journaled side and the opposite side of the anvil adjacent to the material outlet remain free to yield since the other guide rod ends are journaled to the housing and since pressure applying means are pivoted to the anvil substantially intermediate its upper and lower sides. The opposite end of the pressure applying means is supported by the housing, and the arrangement of the elements relative to each other is such that the pressure applying means provide a substantial force component in the tangential direction relative to the curvature of the anvil. Abutment means are provided at both sides of the anvil for adjusting the working gap between the rotor and the anvil. These abutment means assure that a certain minimum spacing will always be maintained between the anvil and the rotor.

It is an important advantage of the shredder according to the invention that any point on the surface of the shredder anvil or rather any point in the effective range of the shredder anvil will not provide an extremely high nor an extremely low resistance against radial deflections by extraneous bodies. An even more important advantage of the invention is seen in that the resistance of the anvil against radial deflections due to extraneous material passing through the shredder will increase only very slightly even if the anvil is deflected to larger extents. The foregoing advantages make sure, that in the practical operation of the present shredder, the anvil will be pressed against the rigid abutment means with such a force during normal operations that a radial yielding of the anvil is avoided in the absence of extraneous matter in the shredder. However, when extraneous bodies enter into the working gap between the rotor and the anvil the latter is capable of making any desired yielding movements which take place without any substantial increase in the resistance against yielding. In other words, the resistance against yielding is substantially uniform, according to the invention, regardless of the extend of the anvil yielding, whereby it is reliably assured that the shredding elements are not damaged and that their useful working life is substantially increased. According to the invention the pivot point at which the tangentially effective force of the spring biased pressure means is introduced into the anvil, is located approximately intermediate the upper and lower sides of the anvil. Therefore, the anvil is able to perform certain pivoting movements about this point in response to extraneous bodies passing through the shredder. This feature of the invention has the advangage that it is avoided to move the entire anvil by larger extents away from the rotor. Stated differently, the gap widths, according to the invention are increased only at the point where an extraneous body passes through the gap, whereas other points of the gap remain substantially unchanged. This feature makes sure that the material is uniformly shredded because the general increasing of the working gap widths is avoided. In shredders of the prior art it was possible for substantial quantities of material to pass through the uniformly larger gap width without being sufficiently shredded. According to the invention, the gap widths remain substantially the same and the anvil only yields locally. These yielding movements take place as the guide rods follow a circular tilting movement about their pivot points secured to the housing with the journal between the anvil and the upper ends of the guide rods following such circular movement. Due to the described arrangement of the elements relative to each other it is now possible to control the yielding resistance of the anvil in a desired manner because the increase in the yielding force becomes smaller when the guide rods are longer and when the line connecting the two journal or pivot axes of the guide rods approximates a tangent to the curvature of the anvil in the area where the guide rod is journaled to the anvil.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
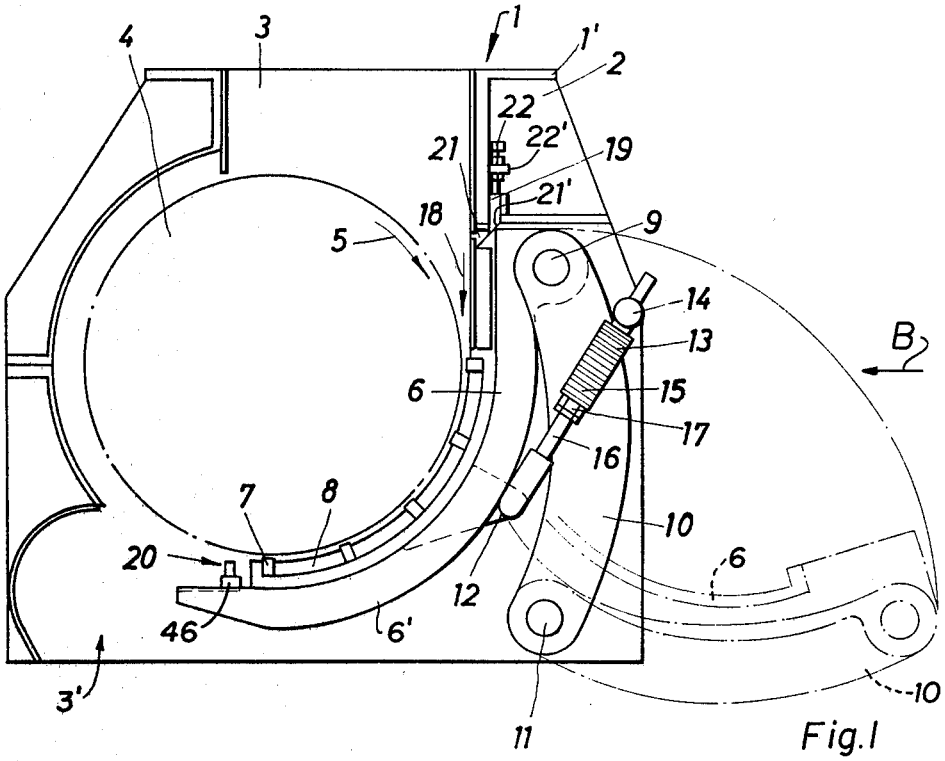
FIG. 1 is a side view of the shredder according to the invention in a somewhat schematic illustration and with one side wall of the housing removed in order to show the position of the anvil and its support means.
Figure 3:
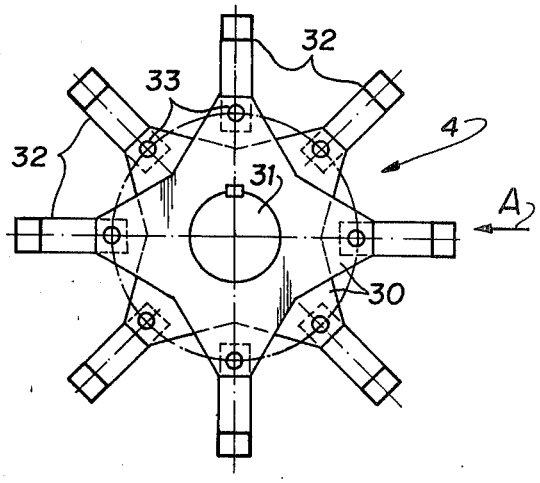
FIG. 3 is a side view of a hammer rotor which may be used in the present shredder.
Figure 4:
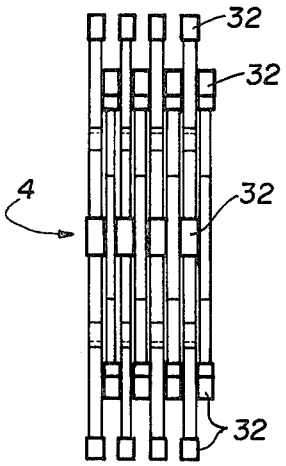
FIG. 4 is a view of the hammer rotor in the direction of the arrow A in FIG. 3.

The shredder 1 of the invention as shown in FIG. 1 comprises a housing 2 having reinforcing ribs 1' and a material inlet opening 3. The material to be shredded is fed into the opening 3 and the material outlet 3' is shown substantially opposite the material inlet 3. Inside the housing 2 there is supported for rotation a rotor 4 by bearings not shown. The rotor 4 comprises several disks 30 of star shaped configuration as best seen in FIG. 3. These disks are keyed to a shaft 31 and carry at their radially outwardly reaching arms hammer means 32 journaled to these arms at 33. The arms of the disks 30 are circumferentially displaced from disk to disk so that the arms of one disk register with the spaces between the arms of the adjacent disk and vice versa, whereby the hammer means 32 are effectively distributed about the circumference of the hammer rotor 4 and whereby the replacement of individual hammer means is greatly facilitated. FIG. 4 shows the staggered arrangement of the hammer means 32 in a side view. The arrow 5 in FIG. 1 indicates the direction of rotation of the rotor 4.

Figure 7:
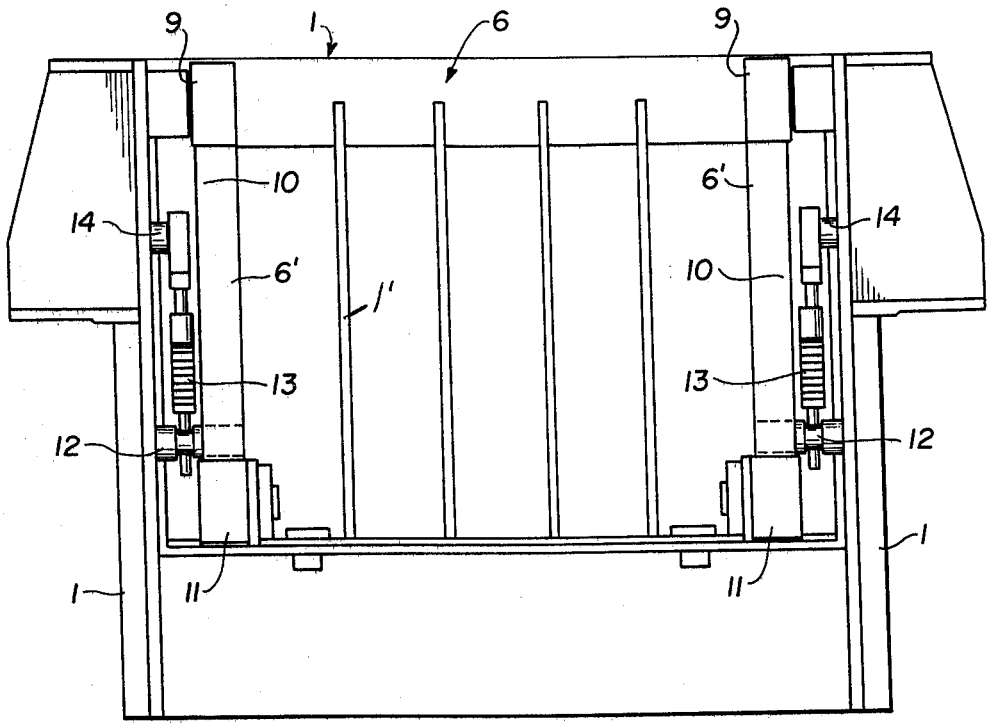
FIG. 7 is a somewhat schematic lateral view of the present apparatus as viewed in the direction of the arrow B in FIG. 1.

In order to properly crush or shred the material such as sugar cane supplied into the inlet 3, the hammers 32 of the rotor 4 must cooperate with the anvil 6. The effective surface area of the anvil 6 as shown in FIG. 1 is curved and the convex side faces the hammer rotor 4 to form a working gap 18. The effective surface area of the anvil 6 extends substantially over an angle of about 90°. The working side of the anvil 6 comprises a grating made up of axially extending bars 7 and circumferentially extending bars 8. These crushing elements 7, 8 are interconnected so as to be easily exchanged, for example, by screws or the like, whereby the maintenance of the shredder 1 is greatly facilitated. Each lateral end of the anvil 6 is provided with an end bar 6' as best seen in FIG. 7. FIG. 7 also illustrates that the same supporting elements are provided at each lateral end of the anvil 6. Referring to FIGS. 1 and 7 there are shown 2 lateral end bars 6' which are journaled to the guide rods 10 at the lateral upper ends as shown by the journal means 9. The guide rods 10 extend downwardly, substantially so that the journal axis 9 and the axis of the journal 11 extend substantially in the same vertical plane. The journal 11 connects the lower end of the respective guide bar 10 to the housing 1. As shown in FIG. 1 by the dash-dotted line the entire anvil structure may be brought into a maintenance position, whereby the anvil 6 and the guide rods 10 extend substantially horizontally. It will be noted that the guide rods 10 do not interfere at all with the accessibility of the anvil 6 proper. To this end it is advantageous that the guide rods 10 also have a curved shape.

Figure 5:
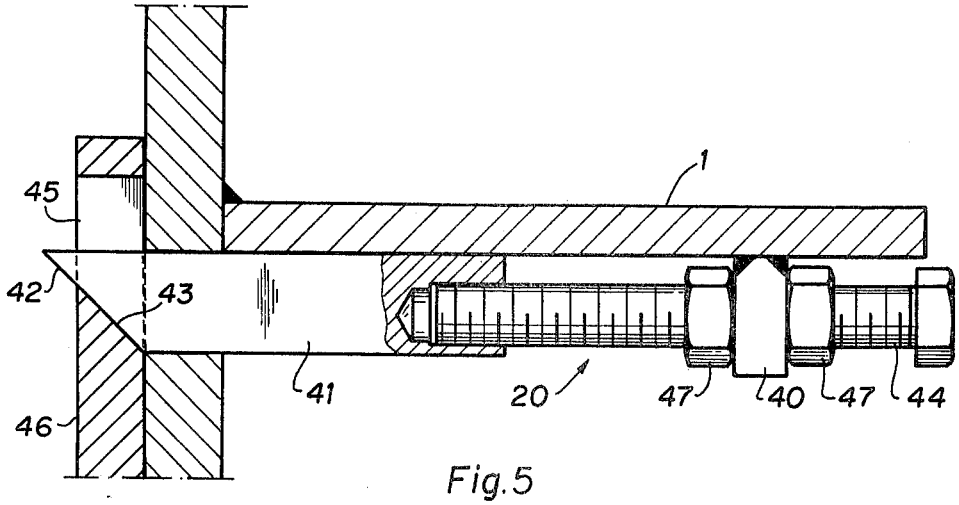
FIG. 5 is a somewhat enlarged illustration of an abutment means which may be used for adjusting the working gap widths in a shredder of the present invention.
Figure 6:
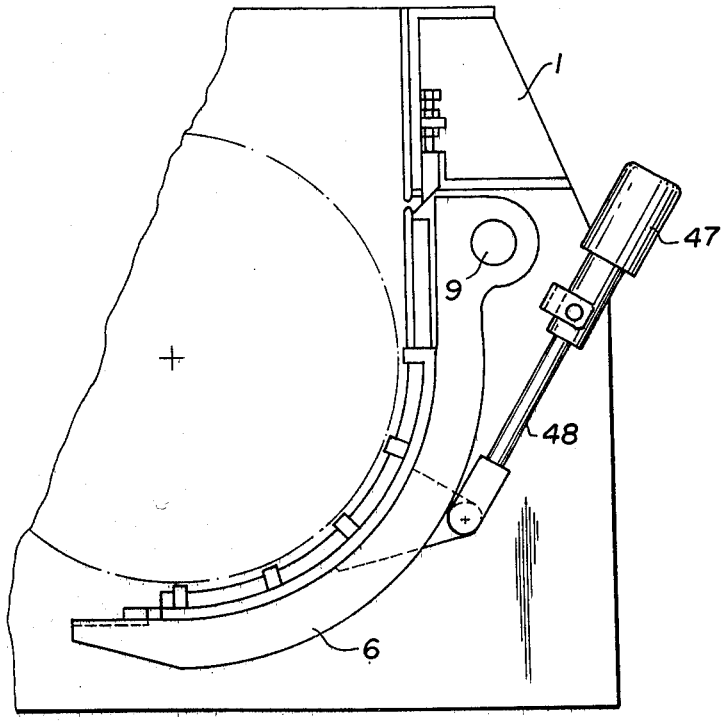
FIG. 6 is a view similar to that of FIG. 1 but showing a hydraulic and/or pneumatic spring bias member for the present anvil extending with its piston rod substantially tangentially to the curvature of the anvil.

As best seen in FIGS. 1 and 7, each lateral end bar 6' of the anvil 6 is pivoted approximately intermediate its ends to a pressure applying means 13 by pivot or journal means 12. The opposite ends of the pressure applying means 13 are journaled or pivoted to the housing 1 by journal members 14. In the example embodiment of FIG. 1 the pressure applying means 13 comprise a plurality of so-called Belleville or cup springs 15 arranged on a threaded spindle 16, whereby the exerted pressure may be adjusted by a nut 17. In order to provide an exactly adjustable working gap 18 between the rotor 4 and the rods 7, 8 of the anvil 6, there are arranged between the housing and the anvil proper adjustment means 19 and 20. As seen in the upper right hand corner of FIG. 1 the adjustment means 19 comprise a screw 22 secured to the housing 2 by means of a threaded collar 22'. A wedge with a wedging surface 21' is movable up and down by means of the screw 22. The upper side of the anvil 6 adjacent to the inlet 3 is provided with a slanted surface 21 which cooperates with the wedging surface 21'. Thus, when the wedging surface 21' moves downwardly, the upper anvil structure will move laterally outwardly by pivoting about the pivot axis 11, whereby the gap 18 may be widened. The cooperating surfaces 21 and 21' assure that the anvil 6 may not move closer to the rotor than is determined by the relative position of these two surfaces to each other. Referring to FIG. 5 there is shown on an enlarged scale an adjustable abutment means 20 similar in structure to the structure of the abutment means 19 shown in FIG. 1. For economy of space the FIG. 5 is shown in a horizontal orientation. However, in practice the longitudinal axis of the adjustment screw 44 may extend vertically. The screw 44 is secured to the housing 1 by a threaded collar 40 for adjusting the wedging member 41 back and forth. The wedging member 41 has a wedging surface 42 which cooperates with a respective slanted surface 43 in an aperture 45 of an anvil member 46. As the wedging member 41 is moved up or down the anvil member 46 is moved substantially horizontally back and forth as indicated by the arrow 23 in FIG. 2. The movement indicated by the arrow 23 is actually a tilting movement about the journal axis 9 whereby the working gap 18 may also be adjusted. As further seen in FIG. 2 the abutment means 19 are movable up and down as indicated by the arrow 62. As in FIG. 1, the threaded screw 44 can be fixed in an adjusted position by tightening the nuts 47. Since the surfaces 42 and 43 can slide relative to each other, it is possible for the anvil 6 including its member 46 to also somewhat tilt, whereby the upper end of the working gap 18 adjacent to the inlet 3 of the housing 1 may be widened, and whereby the journal axis 9 moves along an arc 24, the center of which is the journal axis 11. This movement also causes a relative motion of the journal or pivot point 12 to which the pressure applying means 13 are connected. This motion of the pivot point 12 also follows an arc, the center of which is the journal axis 9. In the light of the just described operation of the yielding action of the present anvil 6, it will be further noted from FIG. 2 that by maintaining the illustrated relationship or geometry between the cooperating elements, very large yielding movement will result only in very small reductions of the effective length of the spring biased pressure applying means 13. This feature of the invention has the advantage that even for very high spring biasing forces and for springs having a steep spring characteristic only very small increases in the resistance against yielding will occur. In other words, the spring biased pressure applying means 13 will apply a substantially uniform pressure against the anvil 6 when the latter tends to yield radially outwardly. This feature of the invention which provides for a substantially tangentially effective biasing force component makes it possible to select suitable springs or to realize suitable spring characteristics by using elastically yielding pressure elements such as pneumatic or hydraulic or hydropneumatic devices. Such spring characteristics may be selected so that within the operating range in which the maximum deflections of the anvil 6 to be expected, will result only in negligibly small or possibly no increases at all in the resistance against deflections of the anvil 6. Incidentally, FIG. 6 illustrates an embodiment in which the Belleville springs 15 have been replaced by a piston cylinder arrangement 47 which may be of the pneumatic or hydraulic or of a hydro-pneumatic type. The piston rod 48 is also arranged so as to extend substantially tangentially relative to the anvil 6. In other respects the function of the embodiment of FIG. 6 is the same as described above with regard to the embodiment of FIG. 1.

Figure 2:
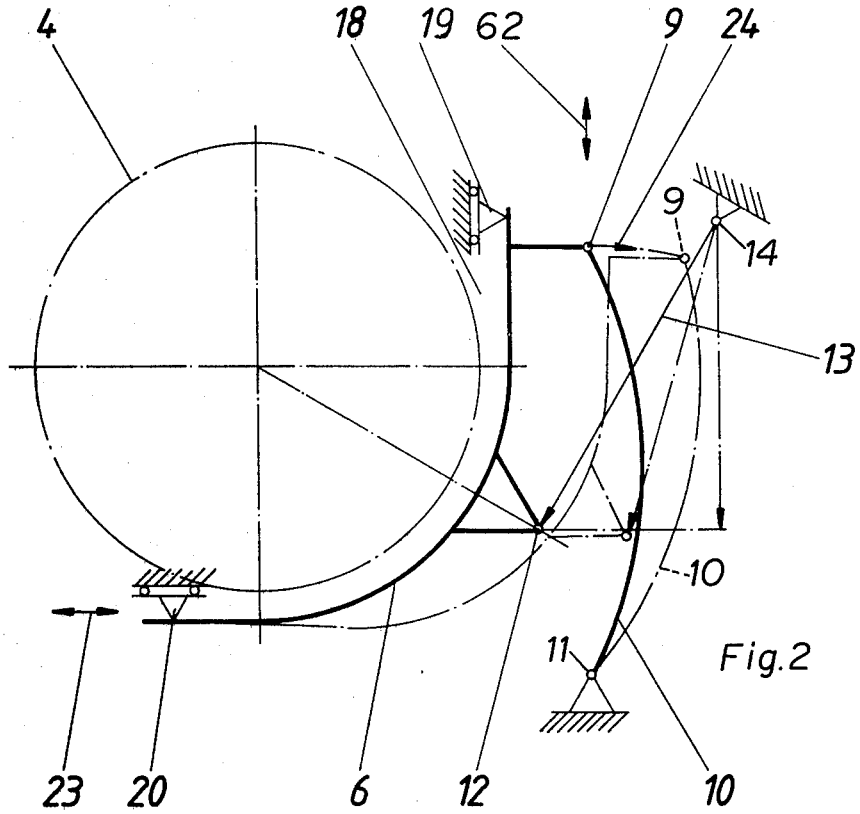
FIG. 2 is a view similar to that of FIG. 1, however, showing in abstract fashion the displacement operation of the anvil and the effective force lines of the anvil support means.

Summarizing the foregoing, it will be noted that by maintaining the relative relationship of the cooperating elements as shown in FIG. 2, the crushing elements 7 and 8 of the anvil 6 as well as the hammers 32 of the rotor 4 are protected against damage and premature wear-out by extraneous bodies passing through the gap 18, because, contrary to prior art shredders, the force pressing the anvil toward the rotor 4 does not increase steeply as the deflection of the anvil increases. As mentioned above and to emphasize the advantages achieved by the invention, the curved guide rods 10, the curvature of which corresponds substantially to that of the anvil, permit tilting the anvil out of the housing as shown in dash-dotted lines in FIG. 1. This feature is very convenient for maintenance and repair work as well as for cleaning and emptying purposes. The arrangement of a cup or Belleville spring assembly 15, as shown in FIG. 1, has the advantage that the initial or bias tension is easily adjusted by means of a nut 17. The Belleville type of spring has the further advantage that high pressures may be exerted even where only short spring excursions are involved. The Belleville springs 15 may be replaced by a gas spring type arrangement as illustrated in FIG. 6. Gas springs have the advantage that the spring characteristics may be influenced substantially to any desired extent.

The advantage of the screw adjustment of the abutment means 19 and 20 is seen in that the gap width may be selected in a very fine manner, thus, it is possible to have a substantially uniform gap width from the inlet to the outlet or to have a gap width which decreases from the inlet toward the outlet or any other modification in the gap width may be selected. This great flexibility in the adjustment of the gap width is especially advantageous where different types of materials are to be shredded or where the gap widths must be adapted to different grades of sugar cane. Due to the combination of features described above, it is possible to limit the anvil substantially to a circumferential arc of about 90° relative to the rotor 4 without diminishing the efficiency of the shredder. However, where it is necessary to crush materials which are difficult to shred and nevertheless maintain a high efficiency, two anvils may be arranged in the same manner as described above for the anvil 6 to cover a larger part of the rotor circumference. The second anvil would be arranged relative to the direction of rotation of the rotor in the same manner as the first anvil and the support of all the elements would be the same as described above. Although the invention has been described to specific example embodiments, it will be appreciated, that it is intended, to cover all modifications and equivalents within the scope of the appended claims.

What is claimed is:

1. A shredder apparatus especially for sugar cane comprising housing means (12) with inlet means for material to be shredded, and outlet means for shredded material, hammer rotor means (4) supported for rotation in said housing means, anvil means (6), guide support means (10) movably supporting said anvil means in said housing relative to said hammer rotor means, said guide support means including first journal means (9) journaling said guide support means (10) to said anvil means (6) and second journal means (11) journaling said guide support means (10) to said housing means (2), independently of said anvil means, resilient pressure means (13) connected to said housing and to said anvil means for cooperation with said anvil means (6) and through said anvil means with said guide support means to yieldingly urge the anvil means toward said hammer rotor means and so that a force component is effective substantially tangentially relative to said anvil means, and adjustable stop means operatively arranged between said housing means and said anvil means for limiting the spacing between said hammer rotor means and said anvil means to a certain minimum, said anvil means (6), said guide support means (10), and said resilient pressure means cooperating in such a manner that the anvil resistance against yielding is substantially constant throughout the range of anvil yielding movement.

2. The shredder of claim 1, wherein said anvil means has an upper edge, a lower edge and lateral ends, said first journal means including first journal members connected to said lateral ends of said anvil means, said resilient pressure means including third journal means operatively connecting said resilient pressure means to said anvil means and fourth journal means operatively connecting said resilient pressure means to said housing means in such positions that a force component is effective substantially tangentially relative to said anvil means.

3. The shredder of claim 2, wherein said first journal means are connected to said lateral ends of said anvil means adjacent said upper edge of said anvil means, and wherein said guide support means and said anvil means enclose an upwardly pointing acute angle, said third journal means being connected to the lateral ends of said anvil means approximately intermediate said upper and lower edge of said anvil means.

4. The shredder of claim 1, wherein said anvil means have a curved shape such that a concave surface defined by said anvil means faces said hammer rotor means and wherein said guide support means also have a curved shape such that a respective concave curvature faces toward said hammer rotor means.

5. The shredder of claim 1, wherein said resilient pressure means comprise a plurality of cup or Belleville spring members, and means operatively arranged to provide an adjustable biasing for said spring members.

6. The shredder of claim 1, wherein said resilient pressure means comprise a pneumatic or gas spring member.

7. The shredder of claim 1, wherein said resilient pressure means comprise piston cylinder means operable as a hydraulic spring means.

8. The shredder of claim 1, wherein said adjustable stop means comprise first slanted surface means, adjustable screw means secured to said housing means and operatively connected to said first slanted surface means, said anvil means comprising second slanted surface means arranged for cooperation with said first slanted surface means to adjust said spacing in response to rotation of said screw means.

9. The shredder of claim 1, wherein said anvil means has a curved shape and extend over an arc of at least 90° relative to said hammer rotor means.

10. The shredder of claim 1, wherein said anvil means comprise a grid structure with axially extending straight bars and with curved bars extending circumferentially relative to said hammer rotor means.

* * * * *